US009931639B2

(12) United States Patent
Lehnig

(10) Patent No.: US 9,931,639 B2
(45) Date of Patent: Apr. 3, 2018

(54) BLAST MEDIA FRAGMENTER

(71) Applicant: Cold Jet, LLC, Loveland, OH (US)

(72) Inventor: Tony R. Lehnig, West Chester, OH (US)

(73) Assignee: COLD JET, LLC, Loveland, OH (US)

( * ) Notice: Subject to any disclaimer, the term of this patent is extended or adjusted under 35 U.S.C. 154(b) by 503 days.

(21) Appl. No.: 14/596,607

(22) Filed: Jan. 14, 2015

(65) Prior Publication Data

US 2015/0196921 A1 Jul. 16, 2015

Related U.S. Application Data

(60) Provisional application No. 61/928,398, filed on Jan. 16, 2014.

(51) Int. Cl.

| | |
|---|---|
| ***B24C 5/02*** | (2006.01) |
| ***B02C 19/00*** | (2006.01) |
| ***B24C 7/00*** | (2006.01) |
| ***B02C 23/16*** | (2006.01) |

(52) U.S. Cl.

CPC ..... *B02C 19/0043* (2013.01); *B02C 23/16* (2013.01); *B24C 7/0046* (2013.01)

(58) Field of Classification Search

CPC ..... B24C 5/02; B24C 5/04; B24C 7/0046; B02C 19/00; B02C 23/16

USPC ..... 451/99, 102, 75, 90, 91, 92, 38, 39, 40

See application file for complete search history.

(56) References Cited

U.S. PATENT DOCUMENTS

| | | | | |
|---|---|---|---|---|
| 1,848,122 | A | 3/1932 | Forster | |
| 2,282,460 | A | 5/1942 | Dickey | |
| 3,070,967 | A | 1/1963 | Uren | |
| 3,576,112 | A | 4/1971 | Frost et al. | |
| 3,670,516 | A | 6/1972 | Duron et al. | |
| 3,952,530 | A | 4/1976 | Tyree, Jr. | |
| 4,038,786 | A | 8/1977 | Fong | |
| 4,253,610 | A | 3/1981 | Larkin | |
| 4,655,847 | A | 4/1987 | Ichinoseki et al. | 134/7 |
| 4,703,590 | A | 11/1987 | Westeraard | |
| 4,727,687 | A | 3/1988 | Moore | |
| 4,744,181 | A | 5/1988 | Moore et al. | |
| 4,806,171 | A | 2/1989 | Whitlock et al. | |
| 4,817,342 | A | 4/1989 | Martin et al. | |
| 4,843,770 | A | 7/1989 | Crane et al. | |

(Continued)

FOREIGN PATENT DOCUMENTS

| | | | |
|---|---|---|---|
| CN | 1263487 | A | 8/2000 |
| CN | 102317035 | A | 1/2012 |

(Continued)

OTHER PUBLICATIONS

IceTech World, Air Consumption Table for High and Low Flow IceSplitters, May 2013, 1 pg.

(Continued)

*Primary Examiner* — Robert Rose

(74) *Attorney, Agent, or Firm* — Frost Brown Todd LLC

(57) ABSTRACT

A fragmenter provides fragmentation of frangible blast media entrained in a subsonic flow. The flow is converged prior to reaching a fragmenting element, and the convergence may be followed by a constant cross-section area section. Immediately upstream and downstream of the fragmenting element may be an expansion area to reduce the potential of water ice buildup.

19 Claims, 5 Drawing Sheets

(56) References Cited

U.S. PATENT DOCUMENTS

| | | | | |
|---|---|---|---|---|
| 4,843,771 | A | 7/1989 | Chapman et al. | |
| 4,947,592 | A | 8/1990 | Lloyd et al. | |
| 5,018,667 | A | 5/1991 | Lloyd | |
| 5,050,805 | A | 9/1991 | Lloyd et al. | |
| 5,071,289 | A | 12/1991 | Spivak | |
| 5,109,636 | A | 5/1992 | Lloyd et al. | |
| 5,188,151 | A | 2/1993 | Young et al. | |
| 5,203,794 | A | 4/1993 | Stratford et al. | 451/75 |
| 5,249,426 | A | 10/1993 | Spivak et al. | |
| 5,265,383 | A | 11/1993 | Shank, Jr. | 451/102 |
| 5,283,990 | A | 2/1994 | Shank, Jr. | |
| 5,288,028 | A | 2/1994 | Spivak et al. | |
| 5,301,509 | A | 4/1994 | Lloyd et al. | |
| H1379 | H | 12/1994 | Meuer | |
| 5,473,903 | A | 12/1995 | Lloyd et al. | |
| 5,509,849 | A | 4/1996 | Spears, Jr. | |
| 5,520,572 | A | 5/1996 | Opel et al. | |
| 5,525,093 | A | 6/1996 | Palmer, Jr. | |
| 5,528,907 | A | 6/1996 | Pint et al. | |
| 5,545,073 | A | 8/1996 | Kneisel et al. | |
| 5,571,335 | A | 11/1996 | Lloyd | |
| 5,616,067 | A | 4/1997 | Groenka | |
| 5,623,831 | A | 4/1997 | Mesher | |
| 5,660,580 | A | 8/1997 | Lehnig | |
| 5,679,062 | A | 10/1997 | Goenka | |
| 5,765,766 | A | 6/1998 | Yoshida et al. | 241/39 |
| 5,795,214 | A | 8/1998 | Leon | |
| 6,024,304 | A | 2/2000 | Sawada | |
| 6,042,458 | A | 3/2000 | Lehnig et al. | |
| 6,173,916 | B1 | 1/2001 | Krone-Schmidt | |
| 6,283,833 | B1 | 9/2001 | Pao et al. | |
| 6,318,649 | B1 | 11/2001 | Mazurkiewicz | 241/5 |
| 6,346,035 | B1 | 2/2002 | Anderson et al. | |
| 6,431,470 | B2 | 8/2002 | Berg | |
| 6,447,377 | B1 | 9/2002 | Londenberg et al. | |
| 6,579,041 | B2 | 6/2003 | Hobbs | 406/121 |
| 6,695,679 | B2 | 2/2004 | Anderson et al. | |
| 6,695,685 | B2 | 2/2004 | Stratford et al. | |
| 6,726,130 | B2 | 4/2004 | Jaubertie | |
| 6,726,549 | B2 | 4/2004 | Rivir et al. | |
| 6,739,529 | B2 | 5/2004 | Linger et al. | |
| 6,824,450 | B2 | 11/2004 | Opel | |
| 7,112,120 | B2 | 9/2006 | Rivir et al. | |
| 7,344,651 | B2 | 3/2008 | Jaubertie | 216/58 |
| 7,383,095 | B2 | 6/2008 | Lee et al. | |
| 7,922,565 | B2 | 4/2011 | Knisel et al. | |
| 7,967,664 | B2 | 6/2011 | Elbing et al. | |
| 8,187,057 | B2 | 5/2012 | Broecker | |
| 8,257,147 | B2 | 9/2012 | Summers et al. | |
| 8,454,409 | B2 | 6/2013 | Bowers et al. | |
| 8,475,230 | B2 | 7/2013 | Summers et al. | |
| 8,801,504 | B2 | 8/2014 | Bowers et al. | |
| 8,869,551 | B2 | 10/2014 | Young et al. | |
| 2003/0064665 | A1 | 4/2003 | Opel | |
| 2010/0075579 | A1 | 3/2010 | Knisel et al. | |
| 2010/0170965 | A1* | 7/2010 | Broecker | B24C 5/04 241/5 |
| 2011/0059681 | A1* | 3/2011 | Bowers | B24C 1/003 451/39 |
| 2014/0110510 | A1 | 4/2014 | Rivir et al. | |

FOREIGN PATENT DOCUMENTS

| | | |
|---|---|---|
| DE | 10 2007 018338 | 10/2008 |
| EP | 0 029 867 | 6/1981 |
| JP | 56054217 | 5/1981 |
| TW | 201131613 A | 9/2011 |
| WO | WO 91/04449 | 4/1991 |
| WO | WO 94/14572 | 7/1994 |
| WO | WO 94/16861 | 8/1994 |
| WO | WO 03/101667 | 12/2003 |
| WO | WO 2004/033154 | 4/2004 |

OTHER PUBLICATIONS

IceTech World, IceSplitter Accessories, 3 pgs., date unknown please consider it as prior art until proven otherwise.

International Search Report and Written Opinion dated Jul. 5, 2006 for Application No. PCT/US2006/009017.

International Search Report and Written Opinion dated Aug. 27, 2008 for Application No. PCT/US2008/063726.

International Search Report and Written Opinion dated Apr. 20, 2010 for Application No. PCT/US2009/069699.

International Search Report and Written Opinion dated Apr. 28, 2015 for Application No. PCT/US2015/011616.

U.S. Appl. No. 61/394,688, filed Oct. 19, 2010.

U.S. Appl. No. 61/487,837, filed May 19, 2011.

U.S. Appl. No. 61/589,551, filed Jan. 23, 2012.

U.S. Appl. No. 61/592,313, filed Jan. 30, 2012.

Chinese Office Action, Notification of the First Office Action and Search Report dated Jun. 1, 2017 for Application No. CN 201580004646, 21 pgs.

* cited by examiner

BLAST MEDIA FRAGMENTER

TECHNICAL FIELD

The present invention relates to method and apparatus for reducing the size of blast media entrained in a fluid flow, and is particularly directed to a method and apparatus for reducing the size of carbon dioxide particles entrained in a subsonic gas flow.

BACKGROUND

Carbon dioxide systems, including apparatuses for creating solid carbon dioxide particles, for entraining particles in a transport gas and for directing entrained particles toward objects are well known, as are the various component parts associated therewith, such as nozzles, are shown in U.S. Pat. Nos. 4,744,181, 4,843,770, 5,018,667, 5,050,805, 5,071,289, 5,188,151, 5,249,426, 5,288,028, 5,301,509, 5,473,903, 5,520,572, 6,024,304, 6,042,458, 6,346,035, 6,695,679, 6,726,549, 6,739,529, 6,824,450, 7,112,120 and 8,187,057 all of which are incorporated herein in their entirety by reference. Additionally, U.S. Patent Provisional Application Ser. No. 61/394,688 filed Oct. 19, 2010, for Method And Apparatus For Forming Carbon Dioxide Particles Into Blocks, U.S. patent application Ser. No. 13/276,937, filed Oct. 19, 2011, for Method And Apparatus For Forming Carbon Dioxide Particles Into Blocks, U.S. Patent Provisional Application Ser. No. 61/487,837 filed May 19, 2011, For Method And Apparatus For Forming Carbon Dioxide Particles, U.S. Patent Provisional Application Ser. No. 61/589,551 filed Jan. 23, 2012, for Method And Apparatus For Sizing Carbon Dioxide Particles, and U.S. Patent Provisional Application Ser. No. 61/592,313 filed Jan. 30, 2012, for Method And Apparatus For Dispensing Carbon Dioxide Particles, Ser. No. 14/062,118 filed Oct. 24, 2013 for Apparatus Including At Least An Impeller Or Diverter And For Dispensing Carbon Dioxide Particles And Method Of Use, all are hereby incorporated in their entirety by reference. Although this patent refers specifically to carbon dioxide in explaining the invention, the invention is not limited to carbon dioxide but rather may be applied to any suitable cryogenic material. Thus, references to carbon dioxide herein are not to be limited to carbon dioxide but are to be read to include any suitable cryogenic material.

It is sometimes desirable to reduce the size of blast media entrained in a fluid flow, prior to directing the flow to a desired location or for a desired effect, such as directing the flow out of a blast nozzle toward a target, such as a work piece. Blast media fragmenters are well known apparatuses, configured to reduce the size of blast media, such as but not limited to carbon dioxide particles, entrained in a fluid flow, such as but not limited to air. Fragmenters define an internal flow path through which the entrained flow of blast media flows and include means for fragmenting the blast media disposed to be impacted by at least a portion of the flow of blast media.

BRIEF DESCRIPTION OF THE DRAWINGS

The accompanying drawings illustrate embodiments, and, together with the specification, including the detailed description which follows, serve to explain the principles of the present innovation.

DETAILED DESCRIPTION

Figure 1:
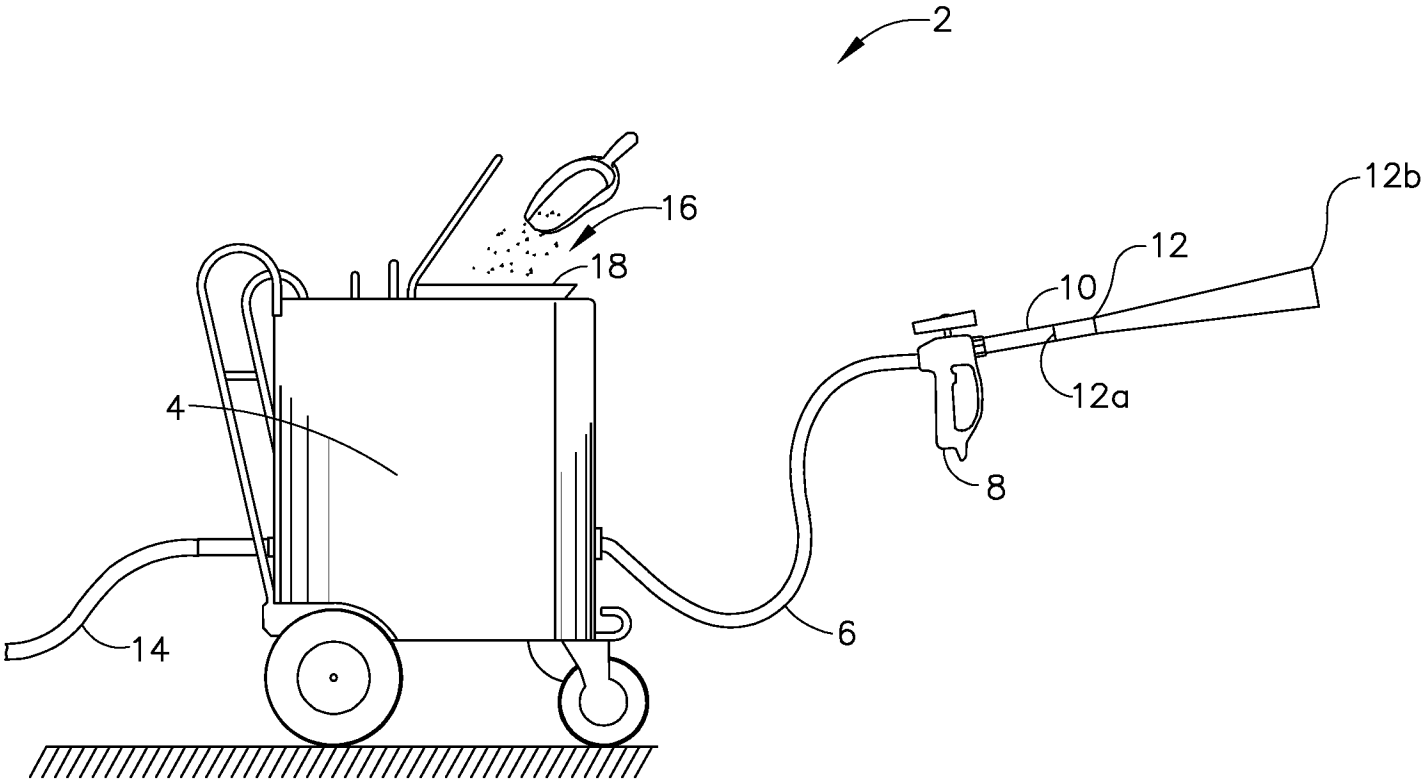
FIG. 1 illustrates a particle blasting apparatus.

In the following description, like reference characters designate like or corresponding parts throughout the several views. Also, in the following description, it is to be understood that terms such as front, back, inside, outside, and the like are words of convenience and are not to be construed as limiting terms. Terminology used in this patent is not meant to be limiting insofar as devices described herein, or portions thereof, may be attached or utilized in other orientations. Referring in more detail to the drawings, an embodiment constructed according to the teachings of the present invention is described.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Referring to FIG. 1, there is shown a particle blast apparatus, generally indicated at 2, which includes cart 4, delivery hose 6, hand control 8, fragmenter 10 and blast nozzle 12. Internal to cart 4 is a blast media delivery assembly (not shown) which includes a hopper, a feeder disposed to receive particles from the hopper and to entrain particles into a flow of transport gas. Particle blast apparatus 2 is connectible to a source of transport fluid, delivered in the embodiment depicted by hose 14 which delivers a flow of air at a suitable pressure, such as 80 PSIG. Blast media, such as carbon dioxide particles, indicated at 16, is deposited into the hopper through top 18 of the hopper. The carbon dioxide particles may be of any suitable size, such as a diameter of 3 mm length. The feeder entrains the particles into the transport gas, thereafter flowing at a subsonic speed through the internal flow passageway defined by delivery hose 6. Delivery hose 6 is depicted as a flexible hose, but any suitable structure may be used to convey the particles entrained in the transport gas. Hand control 8 allows the operator to control the operation of particle blast apparatus 2 and the flow of entrained particles. Downstream of control 8, the entrained particles flow into the internal flow path defined by fragmenter 10, and then into entrance 12*a* of blast nozzle 12. The particles flow from exit 12*b* of blast nozzle 12 and may be directed in the desired direction and/or at a desired target, such as a work piece (not shown).

Blast nozzle 12 may be of any suitable configuration, for example, nozzle 12 may be a supersonic nozzle, a subsonic nozzle, or any other suitable structure configured to advance or deliver the blast media to the desired point of use.

Control 8 may be omitted and the operation of the system controlled through controls on cart 4 or other suitable location. For example, the blast nozzle 12 may be mounted to a robotic arm and control of the nozzle orientation and flow accomplished through controls located remote to cart 4.

Figure 2:
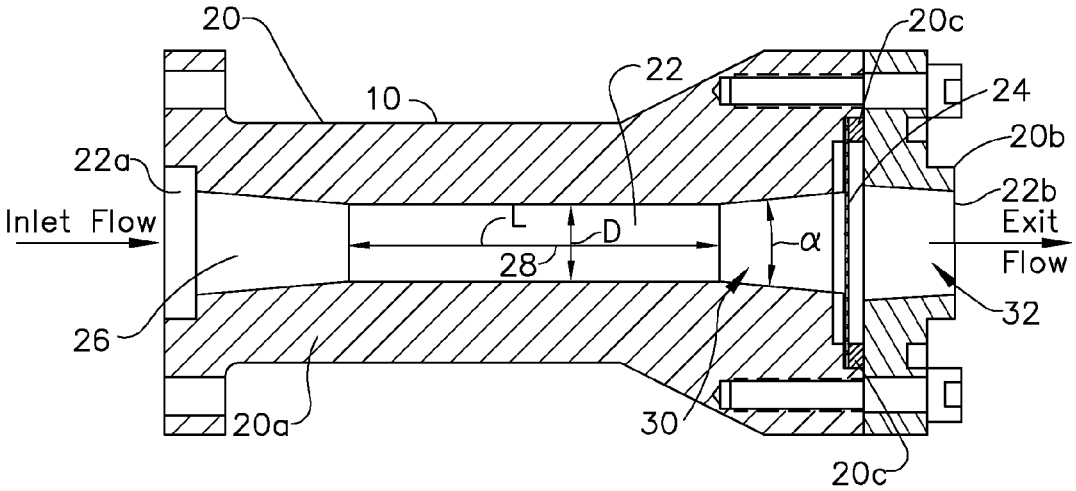
FIG. 2 is a side cross-sectional view of a fragmenter.

Referring to FIG. 2, a side cross-sectional view of fragmenter 10 is illustrated. Although fragmenter 10 is described herein as being disposed adjacent blast nozzle 12, it may be located at any suitable location between the feeder exit and blast nozzle inlet 12*a*, including for example in the middle of delivery hose 6, such as at the junction of a two piece delivery hose 6. Fragmenter 10 includes body 20 which defines at least a portion of internal flow path 22 through which the entrained flow of blast media flows. Internal flow path 22 includes entrance 22*a* and exit 22*b*. Body 20 carries fragmenting element 24 which is disposed to be impacted by at least a portion of the flow of entrained blast media. In the embodiment depicted, fragmenting element 24 is disposed in internal flow path 22 such that the entirety of the flow flows through fragmenting element 24 resulting in all blast media larger than the openings (described below) of fragmenting element 24 impacting fragmenting element 24.

In the embodiment depicted, internal flow path 22 includes converging section 26 which provides a reasonably smooth transition from the slower speed of the entrained flow upstream of fragmenter 10 to a notably higher velocity fluid flow, resulting in minimum loss of available compressed fluid energy. By converging to a smaller area, there is a corresponding change in fluid static pressure, which, for the subsonic flow, corresponds to the creation of a pressure pulse which is communicated through the fluid upstream and downstream of converging section 26. Downstream of converging section 26 is disposed constant cross-section area section 28 having a suitable length, L, to allow the Mach number of the entrained flow to remain sufficiently high enough for the media's kinetic energy to be sufficiently high enough, in view of diameter the cross-sectional area of section 28 and the area of the openings of fragmenting element 24, to ensure the media consistently impact and pass through fragmenting element 24 to avoid clogging. It is within the scope of teachings of this application to achieve the same results by configuring fragmenter 10 without constant cross-section area section 28, with converging section 26 having a convergence angle and length configured to produce equivalent results.

In the embodiment depicted, downstream of constant cross-section area section 28 and upstream of fragmenting element 24 there is shown expansion section 30, having a diverging or increasing cross-sectional area, of a relatively short length and low angle $\alpha$ which may optionally be included to account for water ice buildup along the wall of internal flow path 22 thereby reducing the potential for water ice clogging of fragmenting element 24. As illustrated in the embodiment depicted, internal flow path 22 may include section 32 which presents a slight increase in cross-sectional area immediately downstream of fragmenting element 24, also reducing the potential for water ice clogging. Section 32 may be slightly converging as illustrated. In the embodiment depicted, body 20 is formed of two pieces, 20*a* and 20*b* secured to each other by fasteners with seal 20*c* therebetween. The two piece construction permits assembly of fragmenting element 24 therebetween in internal flow path 22.

Figure 3:
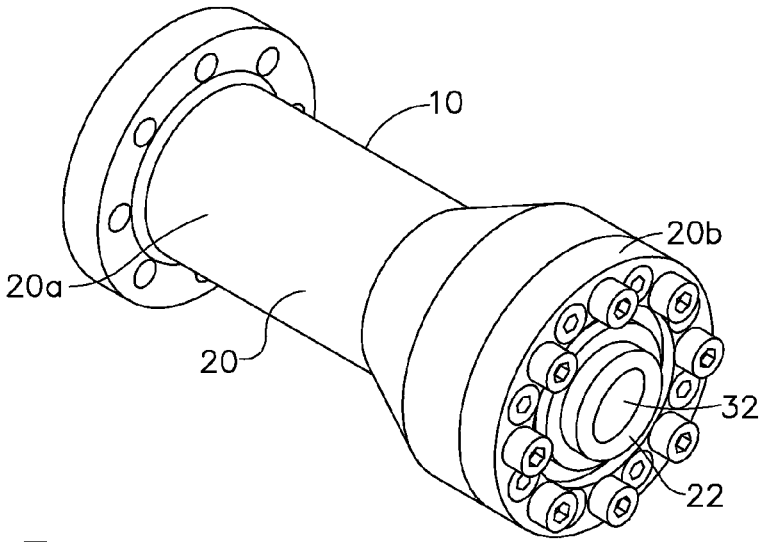
FIG. 3 is perspective view of the fragmenter of FIG. 2.

Although internal flow path 22 is depicted as circular, as can be seen in FIG. 3, any suitable cross-sectional shape may be used, having the appropriately suitable cross-sectional areas as described herein.

Figure 4:
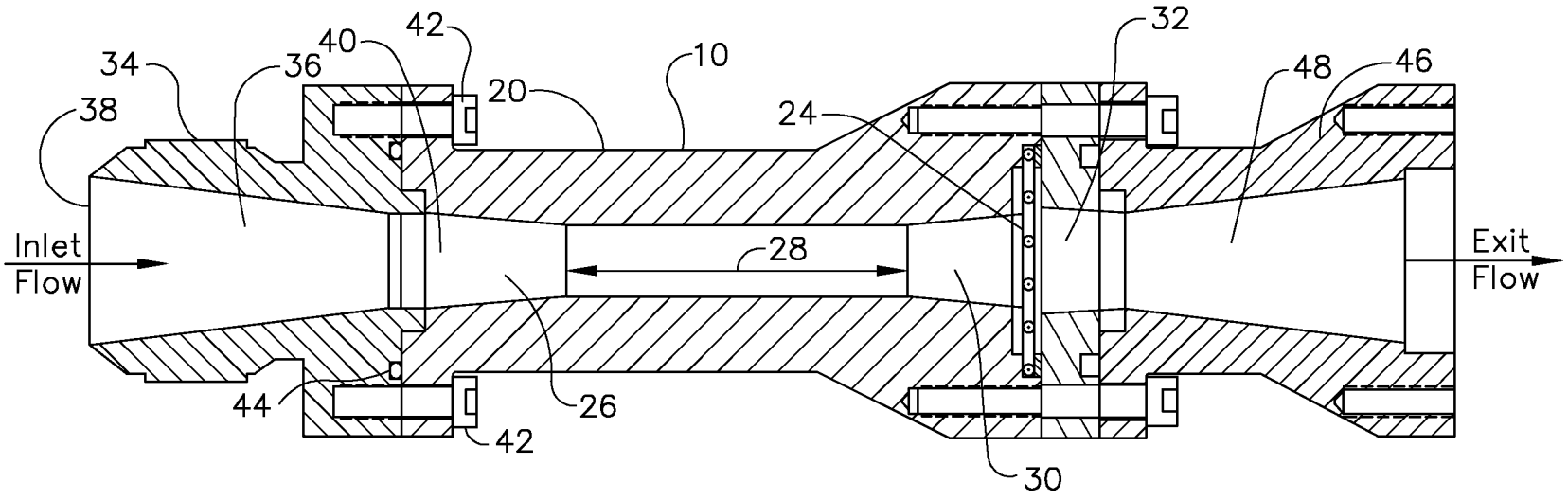
FIG. 4 is a side cross-sectional view of the fragmenter of FIG. 2 with examples of options of upstream and downstream flow control geometry.

The step of converging the entrained particle flow prior to fragmenting element 24 may alternately be accomplished upstream of fragmenter 10 or in addition to converging section 26 of fragmenter 10. Referring to FIG. 4, adapter 34 defines converging section 36 of internal flow path 22 which reduces the larger cross-section area of the entrained flow at inlet 38 to the cross-section area at entrance 40 of converging section 26, providing an even greater area reduction than depicted in converging section 26. Adaptor 34 is configured to mate complementarily with any component disposed immediately upstream thereof, such as control 8 in the embodiment depicted. As discussed above, the upstream component may be any suitable component, and by having different adaptor 34 configurations, a single fragmenter 10 configuration may be used with a range of upstream components. Adaptor 34 may be secured to body 20 in any suitable manner, such as by fasteners 42, and seal 44 may be included.

Similarly, adaptor 46 may, as illustrated, be connected to the exit end of fragmenter 10, configured to mate complementarily with any component disposed immediately downstream thereof. Thus, a variety of different adaptor configurations may be provided having a common upstream configuration to mount to fragmenter 10 and a variety of downstream mounting configurations dependent on the configuration of the downstream component. In the embodiment depicted, adaptor 46 includes diverging section 48. As mentioned above, downstream components include a supersonic blast applicator or nozzle, a subsonic applicator/nozzle or any other component suitable for the intended use of the entrained particle flow.

Figure 5:
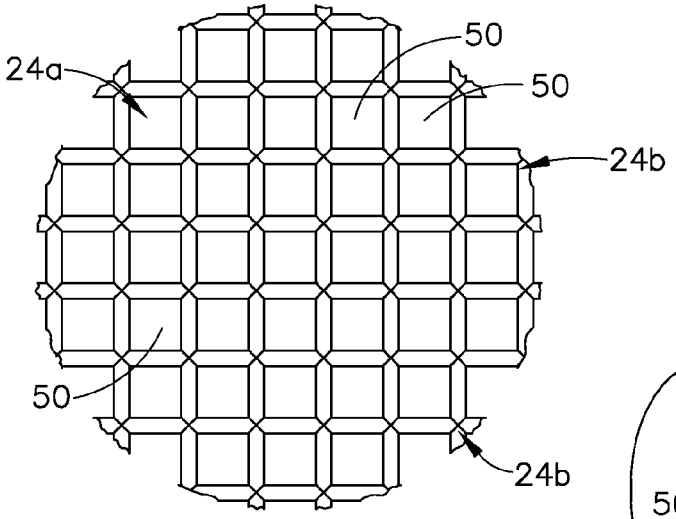
FIG. 5 is a plan view of a fragmenting element.
Figure 6:
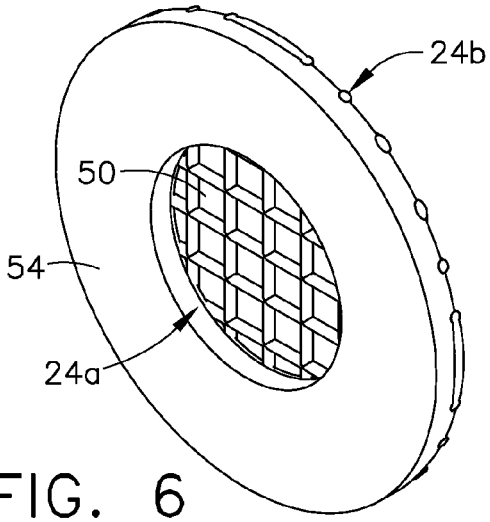
FIG. 6 is perspective view of fragmenting element and support.
Figure 7:
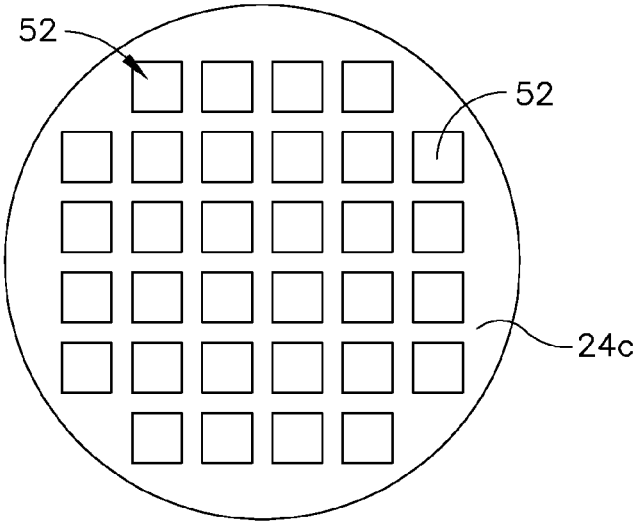
FIG. 7 is a plan view of another fragmenting element.

Referring to FIGS. 5, 6 and 7, there are shown embodiments of fragmenting elements. Any suitable configuration of fragmenting element may be used. Fragmenting element 24 provides a plurality of passages 50, 52 also referred to herein as openings or cells, which are sized based on the desired final size of the media when the media exits the system. The openings of fragmenting element 24 may have any suitable shape, including rectangular, elongated, circular.

FIG. 5 illustrates fragmenting element 24*a* configured as a wire mesh screen. To provide structural support for fragmenting elements, such as the wire mesh configuration of fragmenting element 24*a*, support 54 may be provided as illustrated in FIG. 6. Fragmenting element 24*a* may be attached to support 54 in any suitable manner, such as by welding at a plurality of locations about periphery 24*b* of fragmenting element 24*a*. FIG. 7 illustrates fragmenting element 24*c* with passages 52 laser cut or die cut. Fragmenting element 24*c* may therefore have sufficient thickness to need no additional support. Openings 52 may be undercut, have break edge or have a bell mouth shape.

A plurality of fragmenting elements may be utilized, which may also be configured to have their relative angular orientations externally adjustable so as to provide a variable sized opening to provide variable control to the reduced size of the media.

Fragmenting element 24 functions to change the blast media, such as the disclosed carbon dioxide particles, also referred to as dry ice particles, from a first size, which may be a generally uniform size for the media, to a second smaller size. Thus, all or a portion of the entrained media flows through the openings of fragmenting element 24, with each of the media colliding and/or passing through the openings, being reduced from their initial size to a second size, the second size being dependent upon the cell or opening size. A range of second sizes may be produced.

Figure 8:
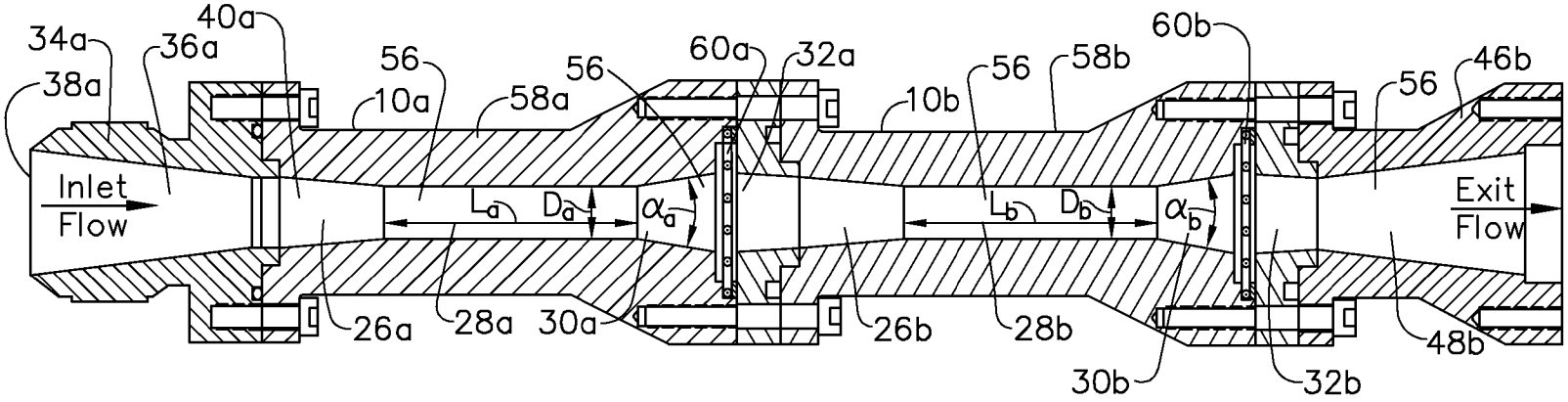
FIG. 8 is a side cross-sectional view of two fragmenters connected together with examples of options of upstream and downstream flow control geometry.

FIG. 8 is a side cross-sectional view of two fragmenters 10*a*, 10*b* connected sequentially. Although two fragmenters are illustrated, more than two fragmenters may be sequentially arranged. Fragmenters 10*a* and 10*b* collectively define at least a portion of internal flow path 56 through which the entrained flow of blast media flows. Body 58*a* carries fragmenting element 60*a* which is disposed to be impacted by at least a portion of the flow of entrained blast media. In the embodiment depicted, fragmenting element 60*a* is disposed in internal flow path 56 such that the entirety of the flow flows through fragmenting element 60*a* resulting in all blast media larger than the openings of fragmenting element 60*a* impacting fragmenting element 60*a*. Body 58*b* carries fragmenting element 60*b* which is disposed to be impacted by at least a portion of the flow of entrained blast media. In the embodiment depicted, fragmenting element 60*b* is disposed in internal flow path 56 such that the entirety of the flow, which has previously passed through fragmenting element 60*a*, flows through fragmenting element 60*b* resulting in all blast media larger than the openings of fragmenting element 60*b* impacting fragmenting element 60*b*.

In the embodiment depicted, internal flow path 56 includes converging section 26*a* which provides a reasonably smooth transition from the slower speed of the entrained flow upstream of fragmenter 10*a* to a notably higher velocity fluid flow, resulting in minimum loss of available compressed fluid energy. By converging to a smaller area, there is a corresponding change in fluid static pressure, which, for the subsonic flow, corresponds to the creation of a pressure pulse which is communicated through the fluid upstream and downstream of converging section 26*a*. Downstream of converging section 26*a* is disposed constant cross-section area section 28*a* having a suitable length, $L_a$, to allow the Mach number of the entrained flow to remain sufficiently high enough for the media's kinetic energy to be sufficiently high enough, in view of diameter the cross-sectional area of section 28*a* and the area of the openings of fragmenting element 60*a*, to ensure the media consistently impact and pass through fragmenting element 60*a* to avoid clogging. It is within the scope of teachings of this application to achieve the same results by configuring fragmenter 10*b* without constant cross-section area section 28*a*, with converging section 26*a* having a convergence angle and length configured to produce equivalent results.

In the embodiment depicted, downstream of constant cross-section area section 28*a* and upstream of fragmenting element 60*a* there is shown expansion section 30*a*, having a diverging or increasing cross-sectional area, of a relatively short length and low angle $\alpha_a$ which may optionally be included to account for water ice buildup along the wall of internal flow path 56 thereby reducing the potential for water ice clogging of fragmenting element 60*a*. As illustrated in the embodiment depicted, internal flow path 56 may include section 32*a* which presents a slight increase in cross-sectional area immediately downstream of fragmenting element 60*a*, also reducing the potential for water ice clogging. Section 32*a* may be slightly converging as illustrated.

In the embodiment depicted, internal flow path 56 also includes converging section 26*b* and downstream converging section 26*b* having a constant cross-section area section 28*b* having a suitable length, $L_b$, to allow the Mach number of the entrained flow to remain sufficiently high enough for the media's kinetic energy to be sufficiently high enough, in view of diameter the cross-sectional area of section 28*b* and the area of the openings of fragmenting element 60*b*, to ensure the media consistently impact and pass through fragmenting element 60*b* to avoid clogging. It is within the scope of teachings of this application to achieve the same results by configuring fragmenter 10*b* without constant cross-section area section 28*b*, with converging section 26*b* having a convergence angle and length configured to produce equivalent results.

In the embodiment depicted, downstream of constant cross-section area section 28*b* and upstream of fragmenting element 60*b* there is shown expansion section 30*b*, having a diverging or increasing cross-sectional area, of a relatively short length and low angle $\alpha_b$ which may optionally be included to account for water ice buildup along the wall of internal flow path 56 thereby reducing the potential for water ice clogging of fragmenting element 60*b*. As illustrated in the embodiment depicted, internal flow path 56 may include section 32*b* which presents a slight increase in cross-sectional area immediately downstream of fragmenting element 60*b*, also reducing the potential for water ice clogging. Section 32*b* may be slightly converging as illustrated.

Similar to the above description, adapter 34*a* defines converging section 36*a* which reduces the larger cross-section area of the entrained flow at inlet 38*a* to the cross-section area at entrance 40*a* of converging section 26*a*, providing an even greater area reduction than depicted in converging section 26*a*. Similarly, adaptor 46*b* may, as illustrated, be connected to the exit end of fragmenter 10*b*, configured to mate complementarily with any component disposed immediately downstream thereof. Thus, a variety of different adaptor configurations may be provided having a common upstream configuration to mount to fragmenter 10*b* and a variety of downstream mounting configurations dependent on the configuration of the downstream component. In the embodiment depicted, adaptor 46*b* includes diverging section 48*b*. As mentioned above, downstream components include a supersonic blast applicator or nozzle, a subsonic applicator/nozzle or any other component suitable for the intended use of the entrained particle flow.

Lengths $L_a$ and $L_b$ are suitable to together allow the Mach number of the entrained flow through flow path 56 to remain sufficiently high enough for the media's kinetic energy to be sufficiently high enough, in view of diameters $D_a$ and $D_b$, the cross-sectional areas of sections 28*a* and 28*b* and the areas of the openings of fragmenting elements 60*a* and 60*b*, to ensure the media consistently impact and pass through fragmenting elements 60*a* and 60*b* to avoid clogging. Of course, corresponding sections of fragmenter 10*a* and 10*b* may have the same dimensions, e.g., $L_a$ may equal $L_b$, $D_a$ may equal $D_b$.

Fragmenting elements 60*a* and 60*b* may be the same or may be different. For example, fragmenting element 60*a* may be sized to reduce the particle size to a first size, such as for example 3 mm roughly in diameter, and fragmenting element 60*b* may be sized to reduce the particles to a second size, such as for example 2 mm roughly in diameter. As particles impact and are reduced in size by first fragmenting element 60*a*, gas will be released off, thereby compensating to some degree for the pressure drop across first fragmenting element 60*a*.

The foregoing description of an embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the innovation and its practical application to thereby enable one of ordinary skill in the art to best utilize the innovation in various embodiments and with various modifications as are suited to the particular use contemplated. Although only a limited number of embodiments of the innovation is explained in detail, it is to be understood that the innovation is not limited in its scope to the details of construction and arrangement of components set forth in the preceding description or illustrated in the drawings. The innovation is capable of other embodiments and of being practiced or carried out in various ways. Also specific terminology was used for the sake of clarity. It is to be understood that each specific term includes all technical equivalents which operate in a similar manner to accomplish a similar purpose. It is intended that the scope of the invention be defined by the claims submitted herewith.

What is claimed is:

1. A subsonic blast media fragmenter comprising a. a body defining an internal flow path, said internal flow path comprising:

i. an inlet;

ii. a converging section disposed downstream of said inlet; and iii. an outlet disposed downstream of said converging section;

said internal flow path configured to maintain a fluid flow with entrained cryogenic blast media particles at subsonic speed from said inlet to said outlet; and b. at least one fragmenting element disposed intermediate said converging section and said outlet, said internal flow path having a first length between said inlet and said at least one fragmenting element sufficient for the entrained particles' speed to increase to the fluid flow's velocity prior to reaching said at least one fragmenting element.

2. The subsonic blast media fragmenter of claim 1, comprising a constant cross-section area section disposed intermediate said converging section and said at least one fragmenting element, said constant cross-section area section's length being sufficient for the entrained particles' speed to increase to the fluid flow's velocity prior to reaching said at least one fragmenting element.

3. The subsonic blast media fragmenter of claim 2, comprising an expansion section disposed intermediate said constant cross-section area section and said at least one fragmenting element.

4. The subsonic blast media fragmenter of claim 3, wherein immediately downstream of said at least one fragmenting element said internal flow path has a larger cross-sectional area than immediately upstream of said at least one fragmenting element.

5. The subsonic blast media fragmenter of claim 1, comprising an expansion section disposed intermediate said converging section and said at least one fragmenting element.

6. The subsonic blast media fragmenter of claim 5, wherein immediately downstream of said at least one fragmenting element said internal flow path has a larger cross-sectional area than immediately upstream of said at least one fragmenting element.

7. A method of changing a size of blast media particles entrained in a subsonic fluid flow, each of said blast media particles having a respective initial size, the method comprising:

a. converging said subsonic fluid flow from a first speed to a second speed, said second speed being subsonic and greater than said first speed;

b. propelling a plurality of said blast media particles through one or more openings defined by a fragmenting element; and c. changing at least one of the propelled plurality of blast media particles from its respective initial size to a second smaller size by said propelling of said at least one of the plurality of said blast media particles through said one or more openings.

8. The method of claim 7, comprising maintaining said subsonic fluid flow at said second speed for a first length prior to propelling said plurality of said blast media particles through said one or more openings.

9. The method of claim 7, comprising, after said subsonic fluid flow has attained said second speed, not converging said subsonic fluid flow for a first length prior to propelling said plurality of said blast media particles through one or more openings.

10. The method of claim 9, wherein not converging said subsonic fluid flow for a first length comprises flowing said subsonic fluid flow through an internal passage way, said internal passageway having a constant cross-sectional area along said first length.

11. The method of claim 7, comprising expanding the subsonic fluid flow immediately prior to propelling said plurality of said blast media particles through one or more openings.

12. The method of claim 7, comprising expanding the subsonic fluid flow immediately after propelling said plurality of said blast media particles through one or more openings.

13. The method of claim 7, comprising converging the subsonic fluid flow after propelling said plurality of said blast media particles through one or more openings.

14. A subsonic blast media fragmenter comprising a. an internal flow path, said internal flow path comprising:

i. an inlet;

ii. a converging section disposed downstream of said inlet; and iii. an outlet disposed downstream of said converging section;

said internal flow path configured to maintain a fluid flow with entrained cryogenic blast media particles at subsonic speed from said inlet to said outlet and b. at least one fragmenting element disposed intermediate said converging section and said outlet, said internal flow path having a first length between said inlet and said at least one fragmenting element sufficient for the entrained particles' speed to increase to the fluid flow's velocity prior to reaching said at least one fragmenting element.

15. The subsonic blast media fragmenter of claim 14, wherein said converging section is disposed immediately downstream of said inlet.

16. The subsonic blast media fragmenter of claim 14, wherein said internal flow path is defined by a body of unitary construction.

17. A subsonic flow path configured to convey a subsonic fluid flow with entrained cryogenic blast media particles at subsonic speed throughout said flow path's length, the cryogenic blast media particles having respective sizes, the subsonic flow path comprising:

a. a converging section configured to transition the subsonic fluid flow from a first speed to a second speed, said second speed being subsonic and higher than said first speed; and b. at least one fragmenting element disposed downstream of said converging section, said at least one fragmenting element configured to reduce the respective sizes of the cryogenic blast media particles as they flow past the fragmenting element said subsonic flow path having a first length upstream of said at least one fragmenting element which is sufficient for the entrained cryogenic blast media particles' speed to increase to the fluid flow's velocity prior to reaching said at least one fragmenting element.

18. The subsonic flow path of claim 17, comprising a constant cross-section area section disposed intermediate said converging section and said at least one fragmenting element.

19. The subsonic flow path of claim 17, wherein the subsonic flow path comprises a larger cross-sectional area immediately downstream of the at least one fragmenting element than immediately upstream of said at least one fragmenting element.

* * * * *